US006270136B1

(12) United States Patent
Dagenais

(10) Patent No.: US 6,270,136 B1
(45) Date of Patent: Aug. 7, 2001

(54) TONG FOR WELL PIPE

(75) Inventor: Daniel W. Dagenais, Edmonton (CA)

(73) Assignee: Farr Canada Ltd. (CA)

( * ) Notice: Subject to any disclaimer, the term of this patent is extended or adjusted under 35 U.S.C. 154(b) by 0 days.

(21) Appl. No.: 09/353,017

(22) Filed: Jul. 13, 1999

(30) Foreign Application Priority Data

Dec. 18, 1998 (CA) ..... 2256298

(51) Int. Cl.[7] ..... B25B 5/08
(52) U.S. Cl. ..... 294/88; 294/119.1
(58) Field of Search ..... 294/88, 86.3, 103.1, 294/113, 116, 119.1, 102.2, 90; 81/57.18, 57.19, 57.21, 57.22, 57.26, 57.28, 57.29, 57.33, 57.34

(56) References Cited

U.S. PATENT DOCUMENTS 1,417,490 * 5/1922 Brandon ..... 81/57.21
3,272,266 * 9/1966 Kennard ..... 294/86.3
3,358,341 * 12/1967 Burstall ..... 294/102.2
3,371,562 * 3/1968 Kelley ..... 294/86.3
3,630,391 * 12/1971 Wilson ..... 294/116
3,847,040 * 11/1974 Bufkin ..... 81/57.18
4,576,254 * 3/1986 Cox ..... 81/57.18
4,649,777 3/1987 Buck .
5,669,653 * 9/1997 Penisson ..... 294/88
5,931,231 8/1999 Mock .

FOREIGN PATENT DOCUMENTS 625-019 * 9/1978 (SU) ..... 81/57.33

* cited by examiner

*Primary Examiner*—Dean J. Kramer
(74) *Attorney, Agent, or Firm*—David J. French

(57) ABSTRACT

A back-up tong is provided with one or more linearly-acting hydraulic cylinders which advance a triangular wedge in order to drive a pipe gripping jaw inwardly into engagement with pipe. A thrust-receiving jaw that is not hydraulically actuated can be adjusted in its fixed position. Springs within the actuated jaw bias it to recoil spontaneously from the pipe upon the retraction of the wedge.

10 Claims, 9 Drawing Sheets

TONG FOR WELL PIPE

FIELD OF THE INVENTION

This invention relates to oil tools for making and breaking tubular connections used in the oil industry. More particularly it relates to a back-up tong for grasping tubular elements, e.g. pipe, casing or completion tubing in the oil well equipment art.

BACKGROUND TO THE INVENTION

In oil well drilling equipment the coupling and uncoupling, or so-called "making" and "breaking" of the connection on tubular is usually effected by pipe gripping tongs. The lower pipe section is usually gripped and held against rotation by a "back-up" tong and the upper pipe section is usually gripped and rotated by an upper "break-out" or "make-up" tong.

A variety of mechanical arrangements have been employed to advance the jaws within a back-up tong in order for such jaws to engage with and grasp the tubular. In U.S. Pat. No. 4,647,777 three jaws are advanced radially inwardly along linear paths by the direct application of hydraulic pressure to the jaws. In U.S. Pat. No. 4,402,239 a pair of opposed jaws are advanced radially inwardly by hinged linkages connected to a hydraulic cylinder. In U.S. Pat. No. 4,778,742 the jaws are carried on hinged supports and are driven inwardly along arcuate paths by the rotation of the supports under hydraulic pressure. Lastly, in U.S. Pat. No. 4,290,304 a pair of opposed jaws are driven radially inwardly by the rotational advancement of a crescent-shaped wedge carried on a "C"-shaped ring that is turned through gearing linked to a hydraulic motor.

In all of the above cases the mechanical systems transmit a force to the jaws that is dependent on the position and shape of the parts, following a single, fixed force-application schedule. While pipe of slight variations in diameter may be accommodated without a change of parts, if pipe of substantially different diameter is to be grasped, major parts must be changed to adjust the schedule by which the force is applied. This is a separate consideration from that of using interchangeable jaws to provide grasping surfaces that accommodate pipes of differing diameters.

It is an object of this invention to provide a mechanical layout for tongs that accommodates the use of a wedge or combination of wedges to place a gripping apparatus about a tubular surface and apply a gripping force thereto. The ready inter-changeability not only of jaws but also of intermediate components that govern the schedule by which force is applied to pipe with the advance of the jaws within a tong render the invention convenient and advantageous.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to one aspect of the invention a tong for grasping tubular members is provided that includes:

(1) a frame having a central pipe opening with a center region and an entry throat for receiving a tubular member to be grasped;

(2) a thrust-receiving jaw carried by a thrust-receiving jaw support that is attached to the frame for fixing the position of the fixed jaw within the pipe opening;

(3) a displaceable jaw assembly containing a radially displaceable pipe-engaging jaw mounted at the inner jaw end of a jaw carrier shaft for advancement of the jaw into the pipe opening;

(4) a wedge with two face surfaces, one of said face surfaces being positioned against the outer wedge end of the jaw carrier shaft, opposite the jaw end;

(5) a thrusting seat coupled to the frame and contacted by the other of the face surfaces of the wedge; and (6) a linear actuator anchored at one end to the frame and aligned at its other end to move the wedge forward between the outer wedge end of the jaw carrier shaft and the thrusting seat for advancement of the displaceable jaw radially towards the center of the pipe opening, whereby activation of said hydraulic actuator for movement of the wedge will advance the jaw carrier shaft and move the displaceable jaw inwardly with respect to the pipe opening to grasp a tubular member contained therein.

To permit the access of pipe to the pipe opening, an entry throat with a gate is provided. The thrust-receiving jaw may be carried by a hinged jaw support connected to the frame which serves as a gate. The hinged jaw support may be swung so as to allow the thrust-receiving jaw to retire and expose the entry throat for pipe to be placed within the pipe opening. With pipe in position within the pipe opening the hinged jaw support may be swung to close the entry throat and position the thrust-receiving jaw so that it is directed towards the pipe or other tubular member that is to be grasped. The hinged jaw support is latched in place during pipe engagement.

The thrust-receiving jaw may be permanently fixed against radial displacement towards and away from the pipe opening. Or it may be adjustable as to its location in order to permit it to occupy a series of fixed positions with respect to the pipe opening. Such adjustable locations may be used to accommodate various ranges of pipes.

The thrust-receiving jaw is preferably adjustable in its radial position with respect to the pipe opening by a screw type adjustable jaw positioning means carried within the hinged jaw support. The jaw positioning means will normally be adjusted so that when the thrust-receiving jaw contacts the pipe, the pipe is approximately centered about the center line of the pipe opening. In this manner, a range of pipe diameters can be accommodated.

As a further feature, the jaw assembly and linear actuator may be rendered repositionable with respect to the frame to permit the accommodation of a larger range of pipe sizes.

The jaw of the displaceable jaw assembly may also be interchangeable to permit substitution of jaws dimensioned to engage with pipes of differing diameters. Further, the wedge may be interchangeable to control the schedule of force being applied by the jaw to pipe.

The jaw assembly includes a jaw carrier shaft that is constrained by guide surfaces carried by the frame to allow the jaw to advance radially towards and away from the pipe opening. The jaw assembly preferably includes means by which the jaw will spontaneously retreat, out of the pipe opening, when the wedge is caused to withdraw under the reverse action of the linear actuator. To provide resilience, a spring means operates to bias the jaw outwardly, away from the pipe opening, to the limit of its marginally permitted displacement with respect to the jaw assembly. This function may be provided through a spring located internally within the jaw carrier shaft. While the prior art has employed a spring attached externally to the jaw and mounted to the outer frame, this new arrangement of the invention avoids exposing the spring to the outside environment, and reduces interference with the operation of the tong.

The jaw assembly and its associated actuator may be displaceable within the body of the tong to allow the tong to accommodate an exceptionally broad range of tubular diameters.

The linear actuator may be in the form of a hydraulic cylinder. Or it may be in the form of a motor and worm gear drive or other equivalent performing apparatus.

The tong of the invention may have a single displaceable jaw or multiple displaceable jaws. When a single jaw is employed, the thrust-receiving jaw may be positioned at the inner side of the pipe opening, facing the throat, and the displaceable jaw may be carried by the hinged jaw support that swings in place across the throat.

Each displaceable jaw will have an associated wedge. However, multiple wedges may be advanced by a single linear actuator.

Normally, a single wedge will be driven by a single linear actuator. However, the wedging action may be arranged to arise through the use of multiple wedges in series. In this case, a single linear actuator can cause two displaceable jaws to advance. The actuator achieves this by advancing a primary wedge which has two primary, wedging, thrust surfaces. Two secondary wedges, each driving a jaw carrier shaft, are then advanced by contact with one of the primary wedging thrust surfaces. The secondary wedges in such cases may have differing angles of inclination, giving rise to differing force schedules for the jaws which they advance.

An advantage of the invention is that the wedge which drives the advancement of the jaw may be interchanged with an alternate wedge to adjust the mechanical advantage that they provide. This provides a means of controlling the schedule of compressional radial force that the jaws apply to the well pipe as they advance radial inward.

The wedges of the invention may be triangular in shape, with flat surfaces. Alternately, compound surfaces having regions of differing angles of inclination may be provided. This allows the force schedule to change as the wedges advance with respect to the thrusting end of the jaw carrier shaft.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
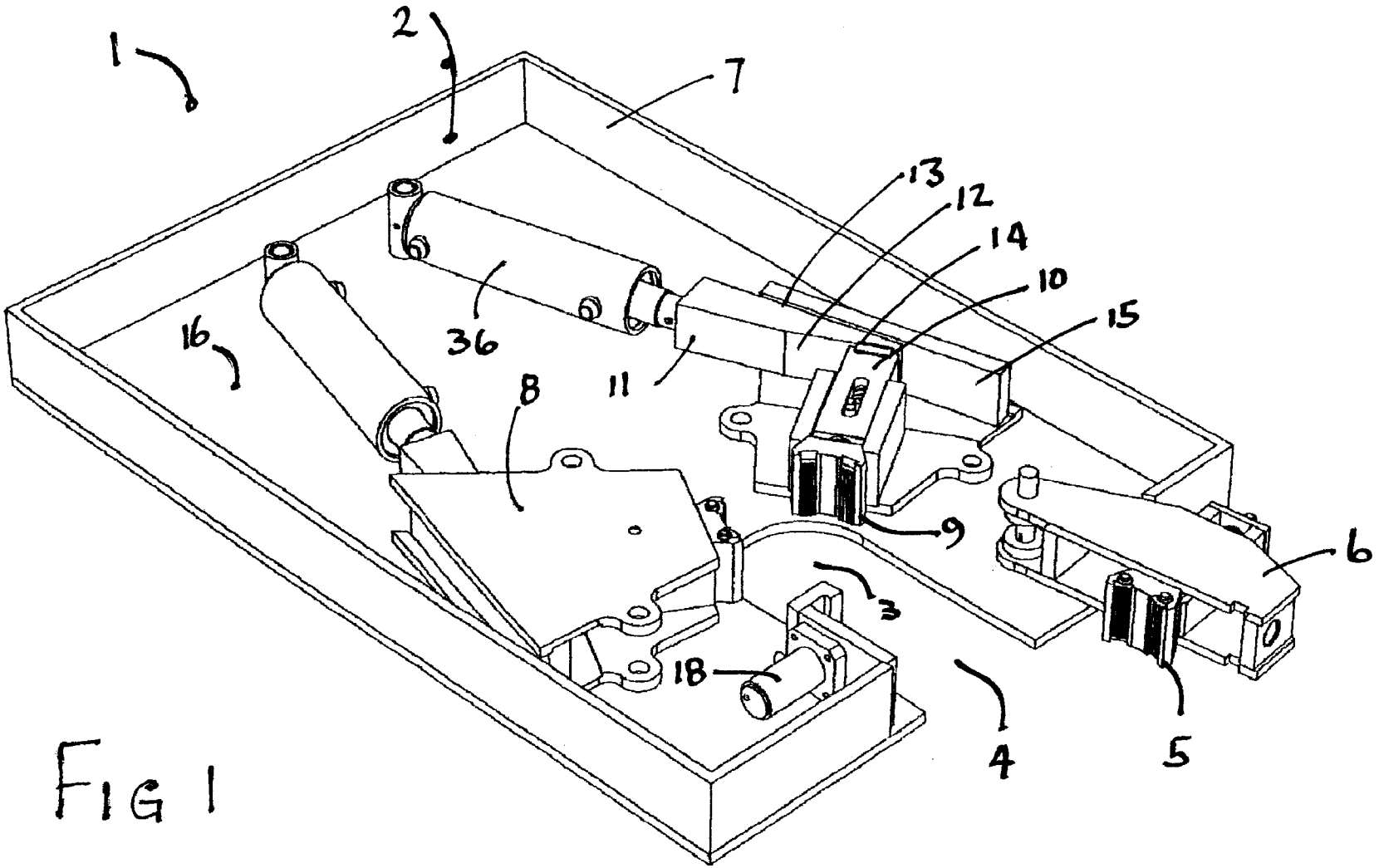
FIG. 1 is a schematic perspective view of the back-up tong of the invention with a top cover plate removed and the pipe receiving throat open.

In FIG. 1 is a tong 1 with dual displaceable jaws 9 has a frame 2 which includes an outer frame wall 7 and upper cover plate 17 and a lower floor plate 16. Various upright spacer walls (not shown) may extending between the lower plate 16 and upper plate 17 to stiffen the frame 2. An optional box beam 58 beneath the lower plate 16 may be present to accommodate lifting forks on a fork lift.

The displaceable jaws 9 are carried by jaw carrier shafts 10 of box-beam form and are positioned around the pipe opening 3. The jaws 9 and their jaw carrier shafts 10 are all carried between upper and lower jaw assembly cover plates 19*a,* 19*b,* creating as an integral unit a displaceable jaw assembly 8 that can be bolted to the upper and lower plates 16,17 at various locations.

Each hydraulic cylinder 36 is anchored to the frame 2 at one end and bears against a wedge 11 at its other end. The wedge 11 passes into the displaceable jaw assembly 8 between the wedge end 14 of the jaw carrier shaft 10 and a thrust seat 15 contained within the jaw assembly 8.

The pipe opening 3 is accessed through throat 4 which can be closed-of by the thrust-receiving jaw 5 on its hinged support 6. A hydraulic cylinder latch 18 locks the support 6 in its closed position, as shown in FIG. 2.

Figure 2:
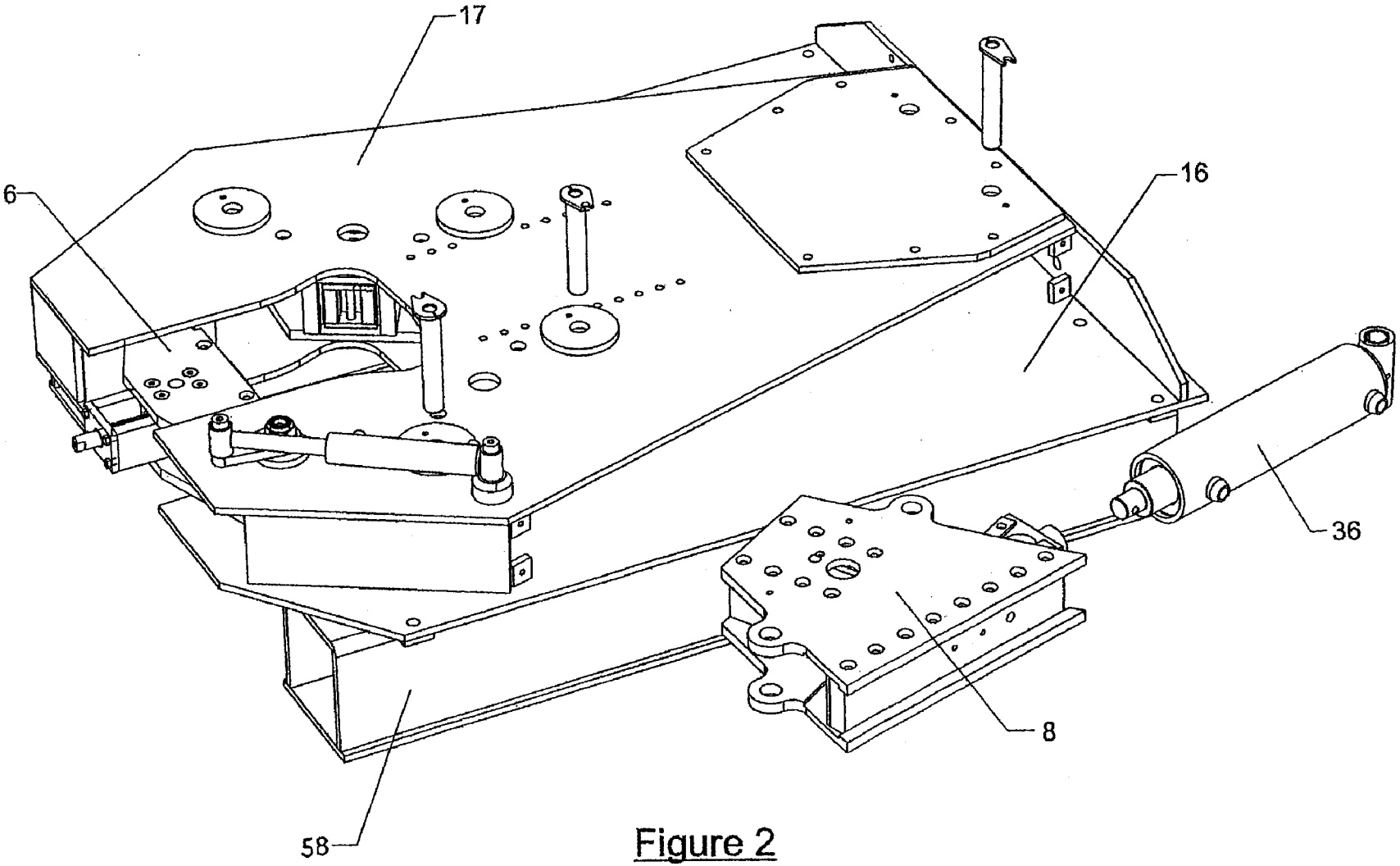
FIG. 2 is an exploded perspective view of the key parts of FIG. 1 taken from a second perspective with the throat closed and with the displaceable jaw assembly and linear actuator separated from the tong body.
Figure 11:
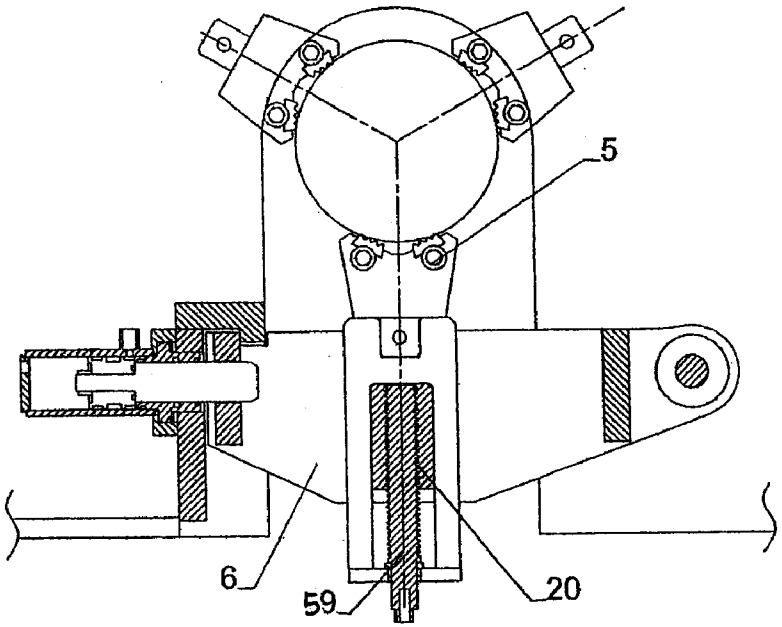
FIGS. 11 and 12 are a detailed plan views of the thrust-receiving jaw and hinged support, showing the thrust-receiving jaw position adjustment mechanism in retired configuration and advanced positions respectively.
Figure 12:
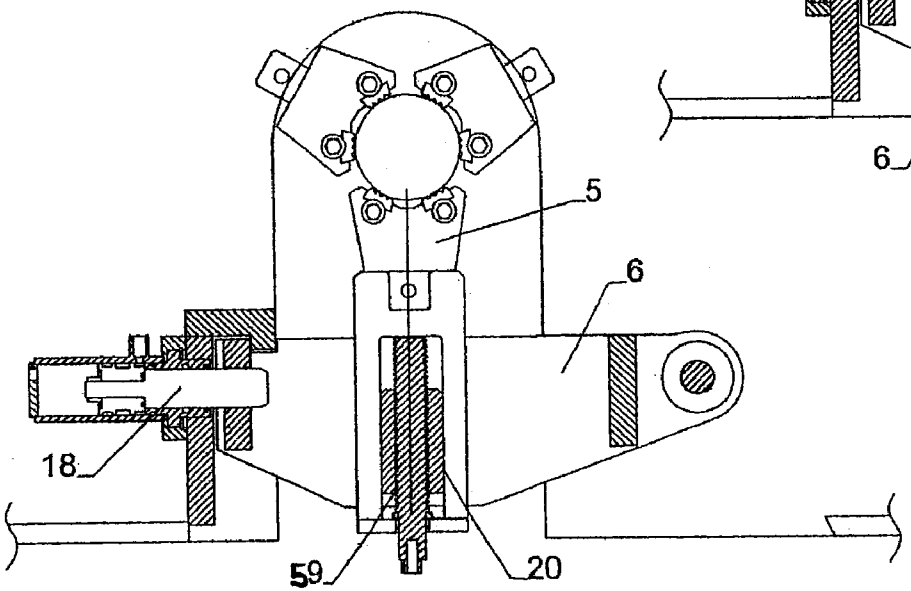

In FIG. 2 the thrust-receiving jaw 5 is carried by a hinged support 6 which serves as a gate for the throat 4. This thrust-receiving jaw 5 is adjustable in its position through means of a threaded shaft 59 shown with the thrust-receiving jaw 5 in retracted and advanced positions respectively in FIGS. 11 and 12. The threaded shaft 59 is shown engaged with a threaded coupling 20 within the thrust-receiving jaw support 6, carrying the thrust-receiving jaw 5 with it as the threaded shaft 59 is rotated.

Figure 3:
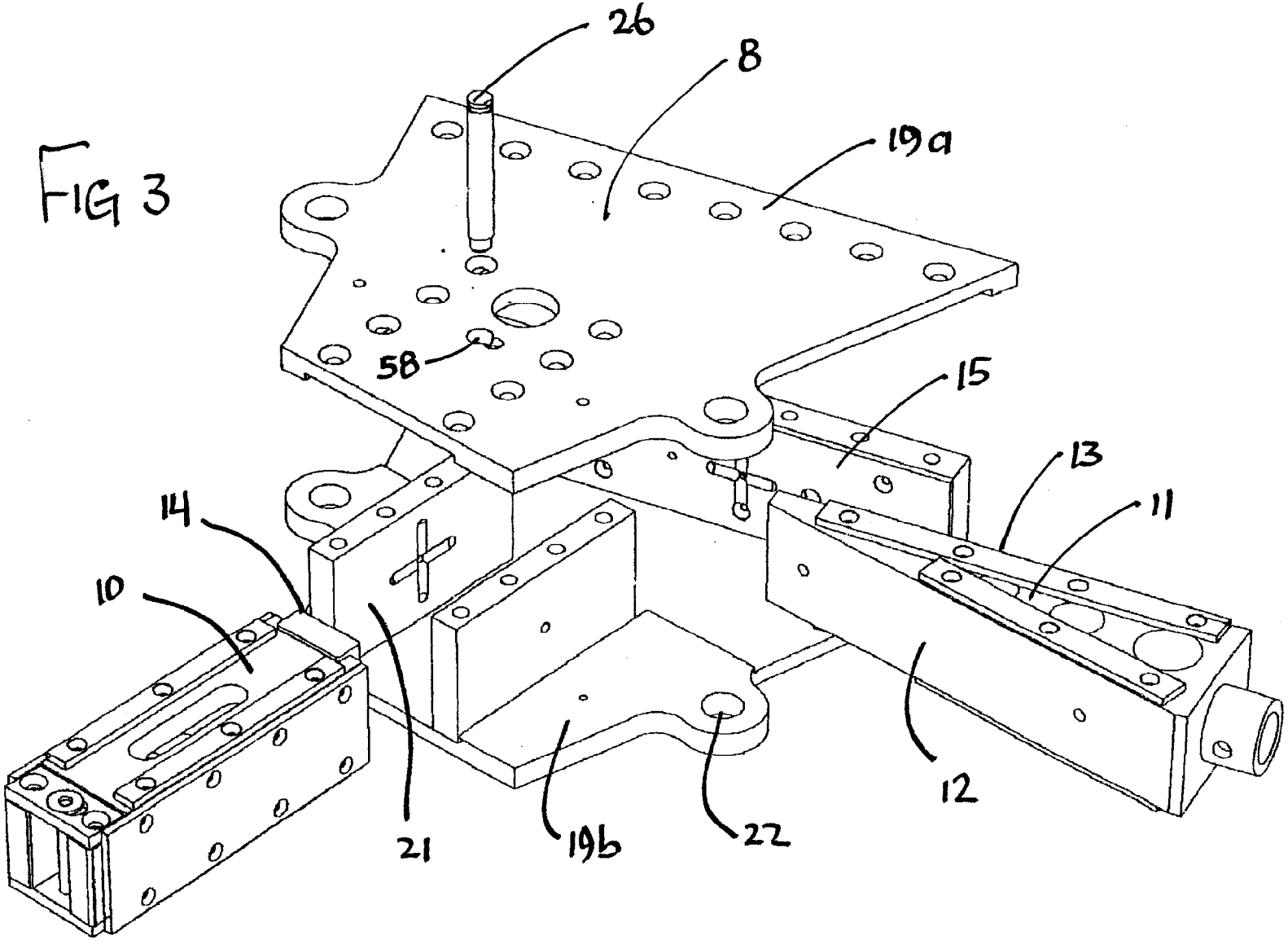
FIG. 3 is a perspective view of the parts of the jaw assembly of FIG. 2.
Figure 4:
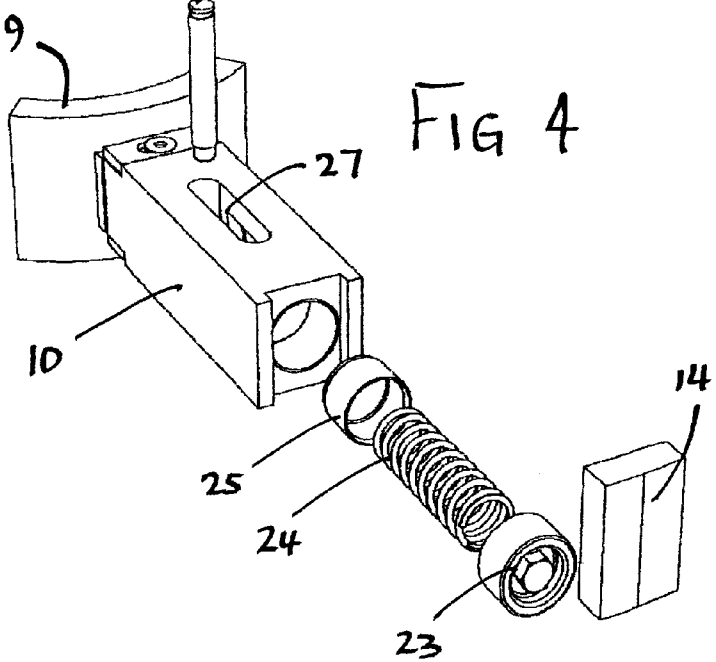
FIG. 4 is an exploded perspective view of a jaw and carrier shaft, including the spring biasing components.

FIG. 3 shows a detail of the jaw assembly 8 with the jaw carrier shaft 10 contained by guide walls 21. The guide walls 21 are rigidly fixed to the jaw assembly cover plates 19*a,* 19*b* which are, in turn fixed to the frame 2 through bolt holes 22.

Included within the displaceable jaw assembly 8 is the triangular wedge 11 which has a bearing surface 12 which contacts with the wedge end 14 of the jaw carrier shaft 10 remote from the displaceable jaw 9. The other side 13 of the wedge 11 contacts a wedge rail that serves as a thrusting seat 15 that is fixed between the jaw assembly cover plates 19*a,* 19*b.*

To provide a means of retraction for the jaws 9 from pipe 30, the wedge end 14 of the jaw carrier shaft 10 may contain a spring seat 23 fixed to the jaw carrier shaft 10 and contacted by spring 24. The spring 24, extending through a bore in the jaw carrier shaft 10, bears at its other end against a spring bushing 25 which in turn bears against a pin 26 that is free to move within a slot 27 in the jaw carrier shaft 10. This pin 26 is, however, fixed in holes 58 in the inner top and bottom cover and floor plates 19*a*, 19*b* which are, in turn, affixed by pins 28 to the top 16 and bottom 17 plates of the frame 2 through plate holes 31,32.

Figure 5:
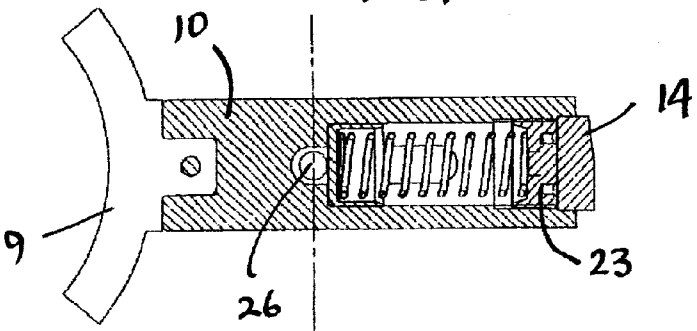
FIG. 5 is a horizontal cross-sectional plan view taken through FIG. 4 when assembled.
Figure 6:
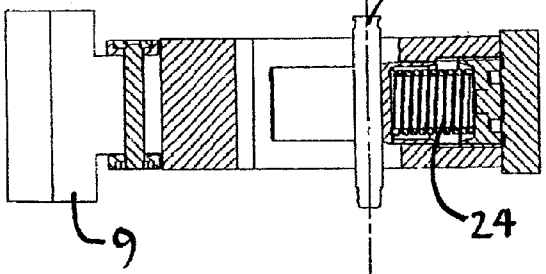
FIG. 6 is a vertical cross-sectional side view taken through FIG. 4 with the jaw carrier shaft advanced as when tubular is being engaged.
Figure 7:
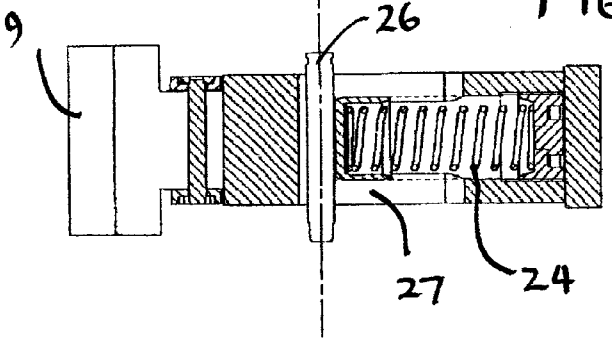
FIG. 7 is a vertical cross-sectional view as in FIG. 6 when the jaw carrier shaft has retired from engagement with tubular.

As shown in FIGS. 5 and 7, the spring 24 thrusts off of the pin 25 against the spring seat 23, biasing the jaw carrier shaft 10 to retract to the limit. When the wedge 11 is engaged, the spring 24 is compressed (FIG. 6) as the pin 25 is allowed to travel down the slot 27 until the jaw 9 engages the pipe 30. When the wedge 11 is retracted the spring 24 retracts the jaw 9 to free the pipe 30 from engagement by the jaw 9.

By shifting the position of the thrust-receiving jaw 5 and allowing for the travel of the displaceable jaws 9 a range of pipe diameters, e.g. from 5.8 inches to 7.0, inches can be accommodated without the necessity of changing the jaws 5,9. When pipe 30 outside of this range is to be grasped, the jaws 5,9, and wedges 11 may be changed to accommodate the new pipe diameters.

One displaceable jaw assembly 8 is shown separated from the tong 1 in FIG. 2, along with its associated linear actuator 36. By reason of this modular construction, this jaw assembly 8 can assume multiple positions within the tong 1, accommodating an extended range of tubular members.

Figure 8:
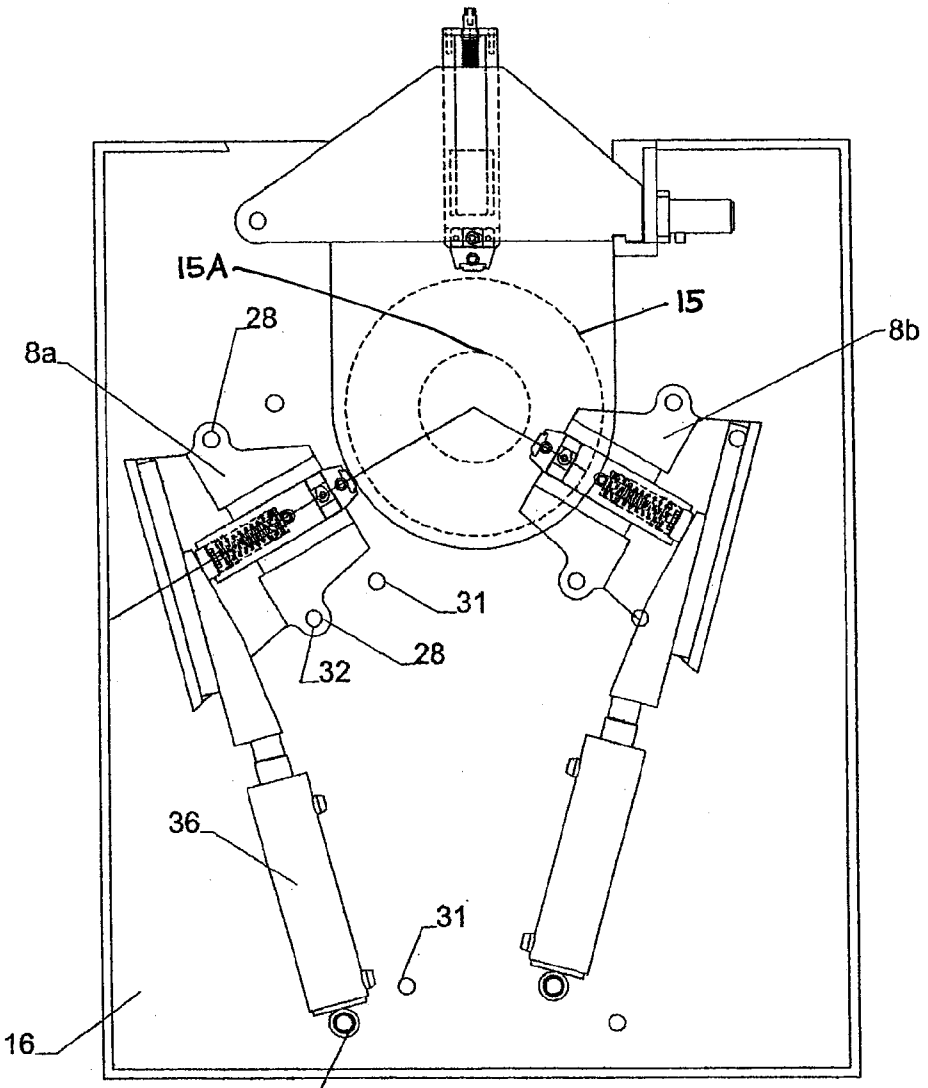
FIG. 8 is a plan view of two jaw assemblies of the tong positioned at two different locations with respect to the lower plate of the tong to engage 20 inch and 8⅝ inch diameter pipe respectively.

As shown in FIG. 8, the jaw assemblies 8 may be shifted on the floor plate 16 between inner 31 and outer 32 attachment holes in the floor plate 16 along with the actuator 36 to provide further flexibility. As depicted in FIG. 8 the left assembly 8*a* is positioned to accommodate 20 inch pipe 15 and the right assembly 8*b* is positioned to accommodate 8⅝ inch pipe 15A.

Figure 10:
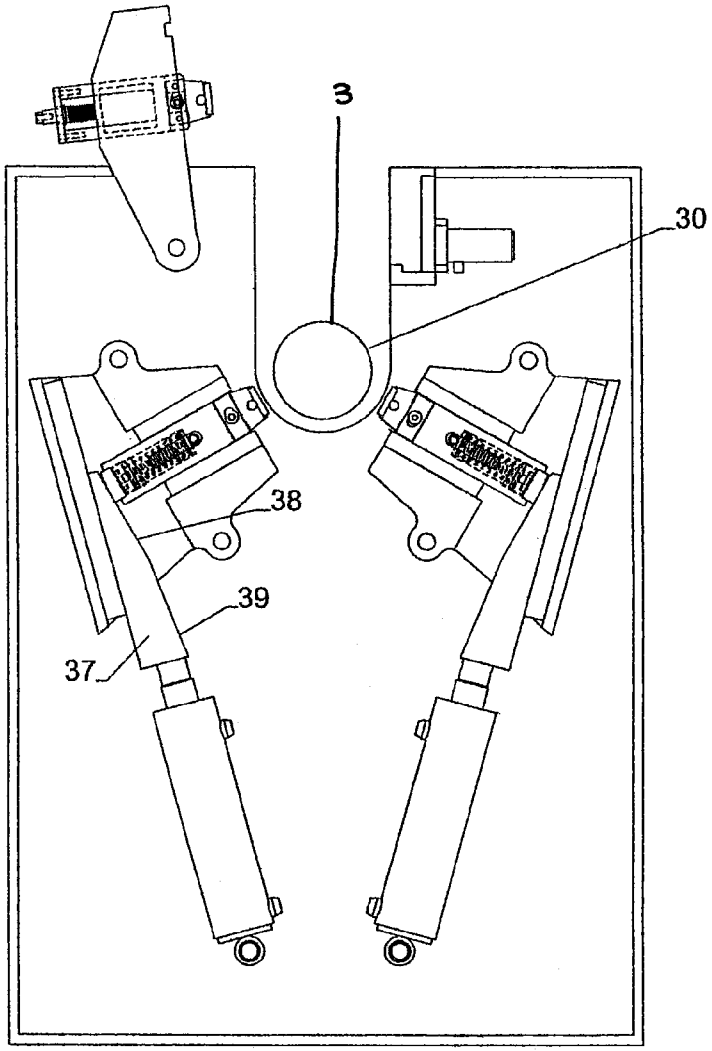
FIGS. 9 and 10 are plan views of the tong with the jaws engaged and retracted using wedges with multiple contact surface slopes.
Figure 9:
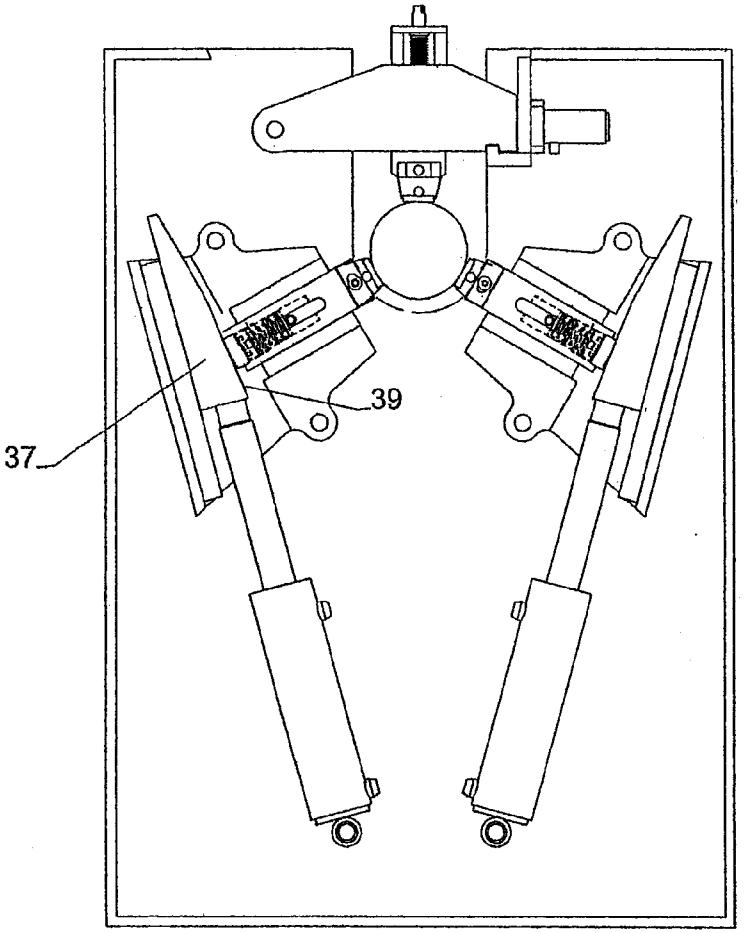

FIGS. 9 and 10 show a tong provided with wedges 37 that have multiple slopes 38, 39 or inclines on the wedge bearing surface that contacts the jaw carrier shaft 10. This will permit the schedule of force applied by the jaws 9 to vary with their degree of advancement towards pipe 30 in opening 3. In particular, an initial steeper slope 38 may provide a rapid-advancement positioning phase; and a second shallower sloped portion 39 may operate in the high torque grasping phase.

Figure 13:
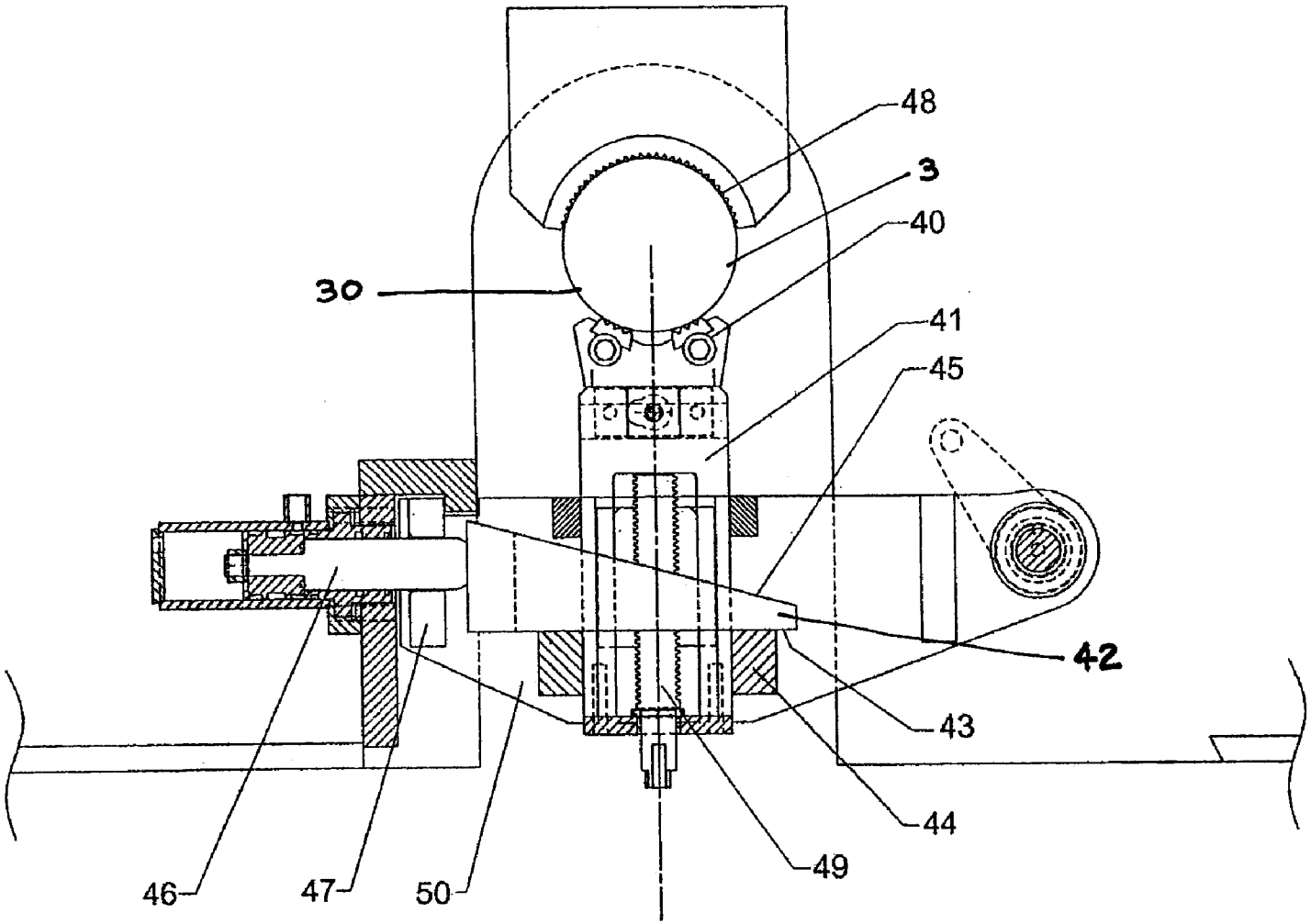
FIG. 13 is a plan view of the throat of a tong having a wedge-driven displaceable jaw present in the gate that closes the throat.

FIG. 13 shows a tong with a single displaceable jaw 40. This jaw is carried on a box shaft 41 that contains a threaded screw 49 for adjusting the advancement of the jaw 40 with respect to the shaft 41. The shaft 41, which is rectangular and hollow has a wedge 42 pierced through it laterally. This wedge 42 may be split to provide a balanced thrust. One face 43 of the wedge 42 bears against thrust posts 44. The other inclined face 45 of the wedge 42 bears against an edge or edges of the shaft 41.

The wedge 42 is advanced by a linear actuator 46 that also penetrates through a locking plate 47 on the hinged support 50 to serve additional as a latch. A fixed rear jaw 48 receives pipe 30 in the pipe opening 3.

Figure 14:
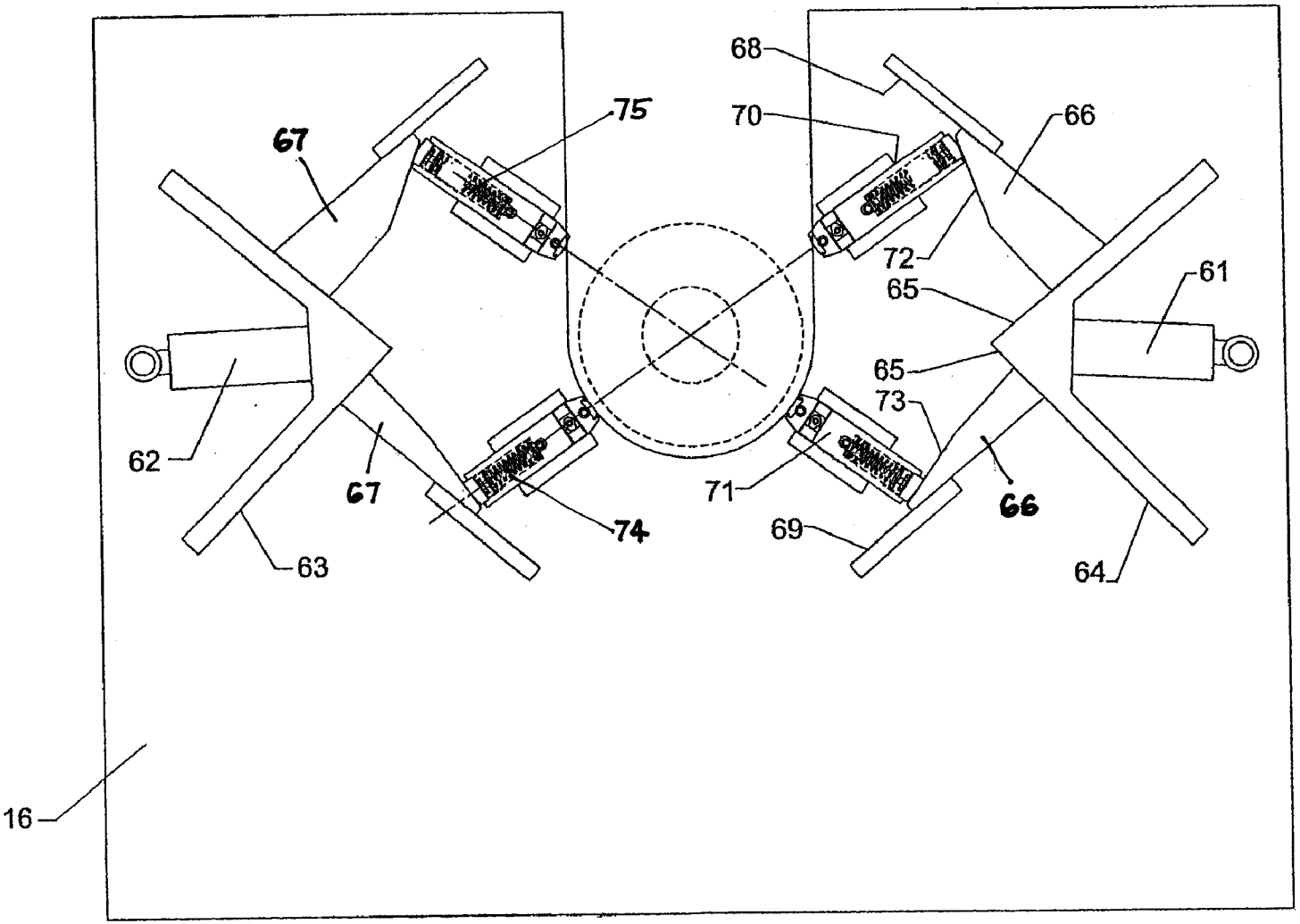
FIG. 14 is a schematic plan view of a tong layout that allows two linear actuators to drive four displaceable jaws.

In FIG. 14 two linear actuators 61,62 anchored to the floor plate 16 of he tong drive two primary wedges 63,654, each of which has two primary wedging thrust surfaces 65. Two pairs of secondary wedges 66,67 are respectively driven off of these respective primary wedges 63,64. On one side the secondary wedges 66 are advanced by the associated primary wedge 64 between their respective thrust seats 68,69 and jaw carrier shafts 60,61. The opposing jaws 74,5 serve as thrust receiving jaw means. Again, secondary wedges 66,67 may have differing angles of inclination of their jaw advancement surfaces 72,73 to provide different force schedules to their respective jaws.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed as follows:

1. A tong for grasping a tubular member comprising:

(1) a frame having a central pipe opening with a center region and an entry throat for receiving a tubular member to be grasped;

(2) a thrust receiving jaw that is connected to the frame for fixing the position of a tubular member to be grasped within the pipe opening;

(3) a displaceable jaw assembly comprising a radially displaceable pipe-engaging jaw mounted on a jaw carrier shaft having an inner jaw end and an outer wedge end, said jaw being mounted at the inner jaw end of the jaw carrier shaft for advancement of said jaw into the pipe opening;

(4) a wedge with two face surfaces, one of said face surfaces being positioned against the outer wedge end of the jaw carrier shaft;

(5) a thrusting seat coupled to the frame and contacted by the other of the face surfaces of the wedge; and (6) a linear actuator anchored at one end to the frame and directed at its other end to advance the wedge between the outer wedge end of the jaw carrier shaft and the thrusting seat, whereby activation of said linear actuator for movement of the wedge will advance the jaw carrier shaft and displaceable jaw inwardly with respect to the pipe opening to grasp a tubular member contained therein and wherein the jaw assembly and linear actuator are repositionable with respect to the frame to permit the accommodation of a range of pipe sizes.

2. A tong for grasping a tubular member as in claim 1, wherein the wedge is provided with a face surface which is a compound surface having regions of differing angles of inclination whereby activation of said linear actuator for movement of the wedge will advance the jaw carrier shaft and displaceable jaw inwardly with respect to the pipe opening to grasp a tubular member contained therein with differing rates of advance.

3. A tong for grasping a tubular member comprising:

(1) a frame having a central pipe opening with a center region and an entry throat for receiving a tubular member to be grasped;

(2) a thrust receiving jaw for fixing the position of a tubular member to be grasped within the pipe opening;

(3) a displaceable jaw assembly comprising a radially displaceable pipe-engaging jaw mounted on a jaw carrier shaft having an inner jaw end and an outer wedge end; said jaw being mounted at the inner jaw end of the jaw carrier shaft for advancement of said jaw into the pipe opening;

(4) a wedge with two face surfaces, one of said face surfaces being positioned against the outer wedge end of the jaw carrier shaft;

(5) a thrusting seat coupled to the frame and contacted by the other of the face surfaces of the wedge; and (6) a linear actuator anchored at one end to the frame and aligned at its other end to advance the wedge between the outer wedge end of the jaw carrier shaft and the thrusting seat, whereby activation of said linear actuator for movement of the wedge will advance the jaw carrier shaft and displaceable jaw inwardly with respect to the pipe opening to grasp a tubular member contained therein and wherein the wedge is interchangeably attached to the jaw assembly to permit the installation of alternate wedges to control the schedule of force being applied by the jaw to tubular member.

4. A tong for grasping a tubular member as in claim 3, wherein the wedge is provided with a face surface which is a compound surface having regions of differing angles of inclination whereby activation of said linear actuator for movement of the wedge will advance the jaw carrier shaft and displaceable jaw inwardly with respect to the pipe opening to grasp a tubular member contained therein with differing rates of advance.

5. A tong for grasping a tubular member comprising:

(1) a frame having a central pipe opening with a center region and an entry throat for receiving a tubular member to be grasped;

(2) a thrust receiving jaw for fixing the position of a tubular member to be grasped within the pipe opening;

(3) a displaceable jaw assembly comprising a radially displaceable pipe-engaging jaw mounted on a jaw carrier shaft having an inner jaw end and an outer wedge end; said jaw being mounted at the inner jaw end of the jaw carrier shaft for advancement of said jaw into the pipe opening;

(4) a wedge with two face surfaces, one of said face surfaces being positioned against the outer wedge end of the jaw carrier shaft;

(5) a thrusting seat coupled to the frame and contacted by the other of the face surfaces of the wedge; and (6) a linear actuator anchored at one end to the frame and aligned at its other end to advance the wedge between the outer wedge end of the jaw carrier shaft and the thrusting seat, and (7) a spring means located within the jaw carrier assembly and coupled between the jaw carrier shaft and the frame to bias the jaw outwardly, away from the pipe opening when the wedge is caused to withdraw under the reverse action of the linear actuator, whereby activation of said linear actuator for movement of the wedge will advance the jaw carrier shaft and displaceable jaw inwardly with respect to the pipe opening to grasp a tubular member contained therein.

6. A tong for grasping a tubular member as in claim 5, wherein the wedge is provided with a face surface which is a compound surface having regions of differing angles of inclination whereby activation of said linear actuator for movement of the wedge will advance the jaw carrier shaft and displaceable jaw inwardly with respect to the pipe opening to grasp a tubular member contained therein with differing rates of advance.

7. A tong for grasping a tubular member comprising;

(1) a frame having a central pipe opening with a center region and an entry throat for receiving a tubular member to be grasped;

(2) a thrust receiving jaw for fixing the position of a tubular member to be grasped within the pipe opening;

(3) a displaceable jaw assembly comprising a radially displaceable pipe-engaging jaw mounted on a jaw carrier shaft having an inner jaw end and an outer wedge end; said jaw being mounted at the inner jaw end of the jaw carrier shaft for advancement of said jaw into the pipe opening;

(4) a wedge with two face surfaces, one of said face surfaces being positioned against the outer wedge end of the jaw carrier shaft;

(5) a thrusting seat coupled to the frame and contacted by the other of the face surfaces of the wedge, and (6) a linear actuator anchored at one end to the frame and aligned at its other end to advance the wedge between the outer wedge end of the jaw carrier shaft and the thrusting seat, whereby activation of said linear actuator for movement of the wedge will advance the jaw carrier shaft and displaceable jaw inwardly with respect to the pipe opening to grasp a tubular member contained therein and wherein the thrust receiving jaw is positioned at the inner side of the pipe opening, facing the throat, and the displaceable jaw is carried by a hinged jaw support mounted on the frame to swing in place across the throat and serve as a gate to the pipe opening.

8. A tong for grasping a tubular member as in claim 7, wherein the wedge is provided with a face surface which is a compound surface having regions of differing angles of inclination whereby activation of said linear actuator for movement of the wedge will advance the jaw carrier shaft and displaceable jaw inwardly with respect to the pipe opening to grasp a tubular member contained therein with differing rates of advance.

9. A tong for grasping a tubular member comprising;

(1) a frame having a central pipe opening with a center region and an entry throat for receiving a tubular member to be grasped;

(2) a thrust receiving jaw means for fixing the position of a tubular member to be grasped within the pipe opening carried by the frame;

(3) two displaceable jaw assemblies each containing a radially displaceable pipe-engaging jaw mounted on a jaw carrier shaft having an inner jaw end and an outer wedge end, each said jaw being mounted at the inner jaw end of the jaw carrier shaft for advancement of the jaw into the pipe opening;

(4) two wedges respectively engaged with a displaceable jaw assembly, each wedge having two face surfaces, one of said face surfaces being positioned against the outer wedge end of the respective jaw carrier shaft;

(5) two respective thrusting seats coupled to the frame and contacted by the other of the face surfaces of a respective wedge; and (6) a linear actuator anchored at one end to the frame and carrying a primary dual-faced wedge at its other end to move both said wedges forward between the respective outer wedge ends of the jaw carrier shafts and the thrusting seats for advancing the displaceable jaws radially towards the center of the pipe opening, whereby activation of said linear actuator for movement of said wedges will advance both jaw carrier shafts and displaceable jaws inwardly with respect to the pipe opening to grasp a tubular member contained therein.

10. A tong for grasping a tubular member as in claim 9 wherein said wedges are each provided with a face surface which is a compound surface having regions of differing angles of inclination whereby activation of said linear actuator for movement of the wedges will advance the respective jaw carrier shafts and displaceable jaws inwardly with respect to the pipe opening to grasp a tubular member contained therein with differing rates of advance.

* * * * *